US006592409B1

(12) United States Patent
Oehme et al.

(10) Patent No.: US 6,592,409 B1
(45) Date of Patent: Jul. 15, 2003

(54) PLUG-IN CONNECTOR FOR CONNECTING SIGNAL AND CURRENT SUPPLY LINES TO A CONSUMER

(75) Inventors: Heinz-Werner Oehme, Weiterstadt (DE); Dieter Lietz, Frankfurt am Main (DE)

(73) Assignee: Continental Teves AG & Co., OHG, Frankfurt (DE)

( * ) Notice: Subject to any disclaimer, the term of this patent is extended or adjusted under 35 U.S.C. 154(b) by 0 days.

(21) Appl. No.: 09/762,845

(22) PCT Filed: Jul. 23, 1999

(86) PCT No.: PCT/EP99/05281

§ 371 (c)(1),
(2), (4) Date: May 11, 2001

(87) PCT Pub. No.: WO00/10231

PCT Pub. Date: Feb. 24, 2000

(30) Foreign Application Priority Data

Aug. 13, 1998 (DE) ..... 198 36 693

(51) Int. Cl.[7] ..... H01R 13/64
(52) U.S. Cl. ..... 439/680; 439/924.1; 439/732
(58) Field of Search ..... 439/101, 680, 439/681, 924.1, 934, 732, 679, 79, 271, 278, 374, 519, 638, 650, 651, 654

(56) References Cited

U.S. PATENT DOCUMENTS 3,794,957 A * 2/1974 Winkler ..... 439/679
4,582,386 A * 4/1986 Martens ..... 439/101
4,915,641 A * 4/1990 Miskin et al. ..... 439/247
5,865,651 A * 2/1999 Dague et al. ..... 439/680

FOREIGN PATENT DOCUMENTS

| | | |
|---|---|---|
| DE | 86 27 007.9 | 3/1987 |
| DE | 37 14 552 | 11/1988 |
| EP | 0 592 212 | 4/1994 |
| GB | 2 295 733 | 6/1996 |
| JP | 09 102362 | 4/1997 |

OTHER PUBLICATIONS

Search Report of the German Patent Office for Application No. 198 36 693.0 Completion Date Nov. 17, 1999, Mailing Date Nov. 24, 1999.

* cited by examiner

*Primary Examiner*—Javaid Nasri
(74) *Attorney, Agent, or Firm*—Rader, Fishman & Grauer PLLC

(57) ABSTRACT

A plug-in connector comprising a plug and a plug socket with a shroud (1) serves to connect a cable containing a plurality of signal lines and current supply lines to a consumer, e.g. the electronic regulator of a vehicle control system. The inside of the plug-in connector is a water-tight housing in which the contacts of the plug engage the connecting contacts of the plug socket (2–6) when plug and plug socket are assembled. According to the present invention, intermediate walls (7,8) divide the interior of the housing into at least three spaces which are separated from each other in a liquid-tight manner. At least one of said spaces is provided for the signal line contacts (6) and at least one each is provided for current supply contacts having the same electrical potential (2,3; 4,5). The current supply contacts are arranged on the end faces of the plug-in connector in such a way that they are separated according to their electrical potential.

4 Claims, 1 Drawing Sheet

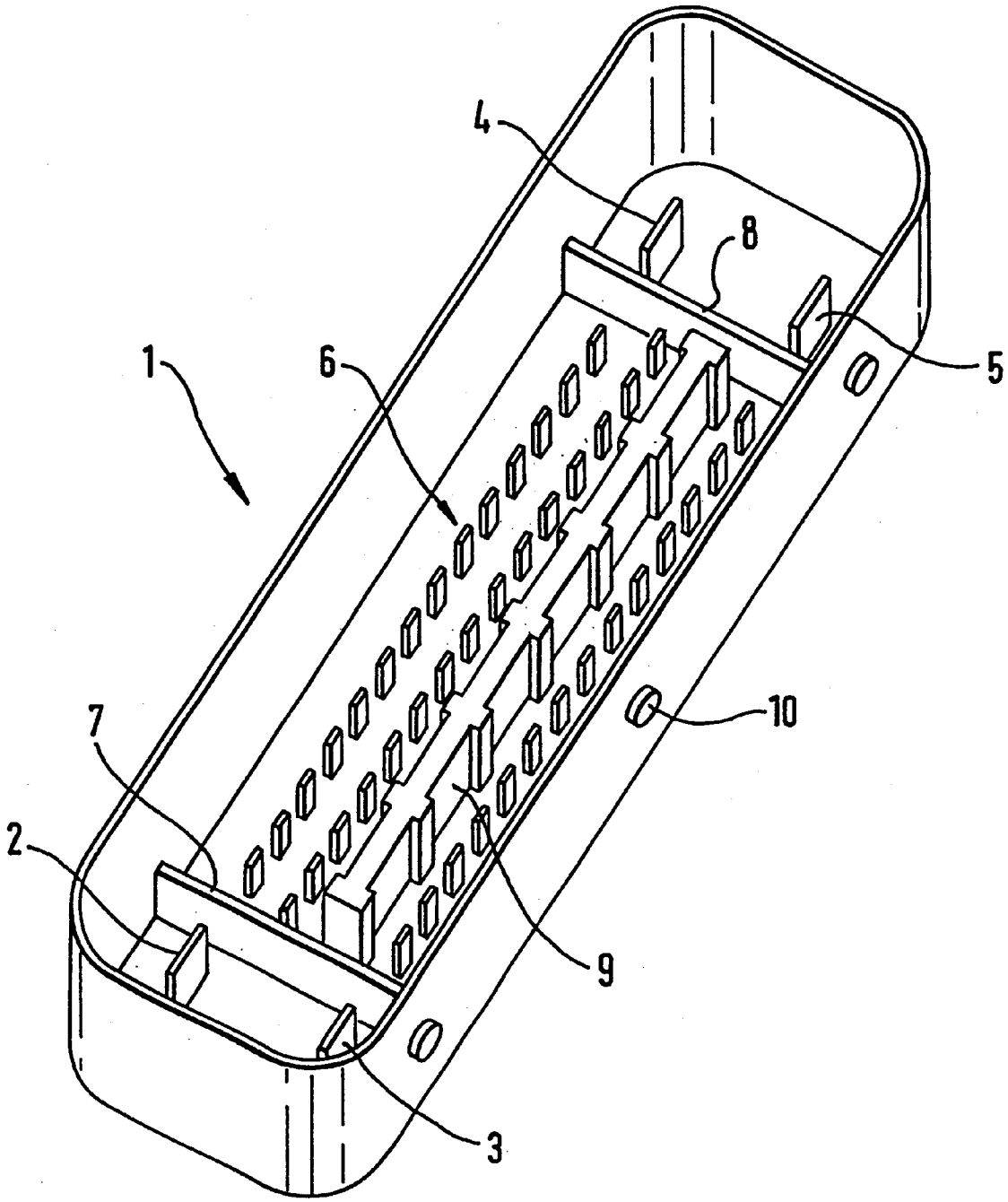
1
2
3
4
5
6
7
8
9
10

PLUG-IN CONNECTOR FOR CONNECTING SIGNAL AND CURRENT SUPPLY LINES TO A CONSUMER

TECHNICAL FIELD

The present invention generally relates to electrical connectors and more particularly relates to a plug-in connector for connecting a cable containing a plurality of signal lines and current supply lines to a consumer, e.g. an electronic regulator of a motor vehicle control system.

BACKGROUND OF THE INVENTION

Such plug-in connectors are already known. If e.g. the plug-in connector shall be accommodated in the engine compartment of a vehicle it is absolutely necessary to protect the contacts and the space in which the contacts engage from penetrating water, oil and dirt. Otherwise leakage currents may be caused between the single contacts and in particular between the contacts serving for the current supply which are designed for high currents. Said leakage currents do not only impair the function of the devices but may also cause a dangerous heat build-up within heating-up of the plug-in connector.

It is therefore object of the present invention to realize a plug-in connector in such a way that it is protected against leakage currents with a relatively simple but rugged structure, high mechanical load carrying capacity and resistance against rough treatment. Furthermore it should be a plug-in connector which can easily be closed and separated in order to minimize the assembly expenditure during production and maintenance of the vehicle.

This object is achieved by the plug-in connector described of the present invention wherein the housing is divided by intermediate walls into at least three spaces which are separated from each other in a liquid-tight manner. At least one of said spaces is provided for the signal line contacts and at least one space each for the current supply contacts having the same electrical potential.

By dividing the space into several interior spaces by means of intermediate walls, dangerous leakage currents are eliminated in a simple and cost-effective manner.

In a preferred embodiment current supply contacts which provide for the current supply—on the one hand to ground and on the other hand to the positive pole of the vehicle battery—are arranged as far from each other as possible in the plug-in connector in order to obtain a high resistance in case of failures relating to penetration of humidity or dirt.

If nonetheless there is a dirt accumulation, a current flow from a current supply contact to a signal contact is only a minor problem because said current flow does not lead to a heating-up of the device but at most to a fault which would be indicated in time by the usual monitoring and warning systems.

BRIEF DESCRIPTION OF THE DRAWING

FIG. 1 represents in a perspective view a plug-socket and a shroud which serves to accommodate a plug.

DETAILED DESCRIPTION OF THE PREFERRED EMBODIMENTS

Such a plug, represented as one exemplary embodiment of the invention, connects the electronic regulator (ECU) of a vehicle control system electrically. Such a plug-in connector is particularly endangered if the electronic regulator is arranged in the engine compartment of the vehicle.

The size of the plug is subject to the system; the invention was tested with plug-in connectors with 47 and 26 poles (electrical pins). Principally, the structure according to the present invention is also suitable and advantageous for other sizes.

The shroud 1 represented in the FIGURE is part of a plug socket. The shroud 1 sits on a regulator housing (not represented) and can be produced, e.g. injection-moulded, together with the former; it is also possible, however, to use a part which has been injection-moulded previously or a prefabricated insert.

Shroud 1 and the plug-in connector according to the present invention show the following differences with regard to previously used plug shrouds not being provided with intermediate walls:

The permanently current-carrying "power contacts" (i.e. the contacts 2,3; 4,5;), typically used for the current supply, are no longer arranged adjacent to each other, but on the opposite end faces of shroud 1 and separated from the signal contacts 6 by means of intermediate walls 7,8 extending in transverse direction. Thus the interior space is divided into three (or more) spaces eliminating an electrical connection between the positive pole respectively the power contact connected to the positive pole of the battery and the minus pole or the ground in the shroud and herewith the danger of a short circuit and fire if small amounts of humidity penetrate the housing.

In the embodiment represented in the FIGURE two power contacts each 2,3; 4,5 having the same electrical potential are arranged in groups at the inside of a space which is closed when the plug has been attached. Within this group there can be no short circuits. Since the power contacts with different electrical potential are arranged on the opposite sides respectively front ends or side walls of the shroud, the danger of a high-current by-pass is minimized.

In the represented embodiment, the shroud also contains a massive plastic rib 9 extending in longitudinal direction which has the following functions:

Preguide of the mating plug:

The height of the longitudinal rib 9 guarantees that during assembly it is rib 9 to be first introduced into the mating plug. Thus an exact preguide is achieved; the matching of the contacts in the mating plug—plug and plug socket—is facilitated. The "tolerance chain" is shorter than in case of plugs without such guide ribs.

Coding:

A coding is achieved by recesses in the rib thus saving space on the outer wall in longitudinal direction with regard to the measures taken up to now.

Assembly protection:

The assembly is protected against a mating plug turned about 180 degrees, because rib 9 is positioned off-center with regard to the longitudinal direction of the shroud.

Contact safety device:

The height of the longitudinal rib 9 avoids that the contacts and the mating plug touch each other thus excluding their damage by inappropriate treatment.

Symmetrical naps on the shroud:

By symmetrically arranging locking naps 10 on the outside of the shroud 1 it is possible to use mating plugs (not shown) which can be locked alternatively from one of the two end faces without a change on the plug shroud being necessary. The contacts 2–6 are arranged on the shroud 1 in such a way that several customer-specific contact systems can be used without the necessity of changing the execution of shroud 1.

The position of the contacts is independent from the contact types used and allows a higher standardization of the printed circuit boards used in the regulator. It is no longer necessary to adjust the footprint on the PCB to the customer-specific plug systems with different grid-/row distances.

As already described, in the embodiment represented in the FIGURE the end faces are provided with two power contacts 2,3; 4,5 each having the same electrical potential, but belonging to different electric circuits. Such a division into several current supply contacts (with the same electrical potential) can also be advantageous or even necessary for mechanical reasons or for delimiting the contact surface.

What is claimed is:

1. A plug-in connector, comprising:

a plug;

a shroud extending from said plug, said shroud and plug enclosing a contact area;

wherein the plug serves to connect a cable containing a plurality of signal lines and current supply lines to a consumer, wherein the plug includes intermediate walls dividing the shroud into at least three divisions separated in a liquid-tight manner from each other;

at least one signal line contact disposed in a first one of said at least three divisions; and a first and a second current supply contact both having the same electrical potentials and both disposed on a same plane as the at least one signal line contact, wherein both said first and second current supply contacts are disposed in a second one of said at least three divisions, and wherein the potentials associated with the first and second current supply contacts are positive potentials.

2. The plug-in connector according to claim 1, wherein said at least one signal line contact includes a plurality of signal line contacts inside the plug, wherein the signal line contacts inside the plug are arranged along one contact face of the plug in said first division, and wherein a third current supply contact having an opposite potential from said first and second current supply contacts is disposed in a third one of said at least three division.

3. The plug-in connector according to claim 2, wherein the contact face extends in a longitudinal direction greater than in a traverse direction, and wherein said first division is located between said second and third divisions.

4. The plug-in connector according to claim 1, further including a coding and guide rib.

* * * * *